United States Patent [19]

Montefeltro R.

[11] 4,077,384

[45] Mar. 7, 1978

[54] TARGET PIGEON AND LAUNCHING APPARATUS THEREFOR

[76] Inventor: Ludovico Lante Montefeltro R., Avda. Libertador Edif.Siclar, 2°Piso, Ofic. No. 23, Caracas, Venezuela

[21] Appl. No.: 679,135

[22] Filed: Apr. 21, 1976

Related U.S. Application Data

[63] Continuation-in-part of Ser. No. 604,069, Aug. 12, 1975, abandoned.

[30] Foreign Application Priority Data

Aug. 19, 1974 Venezuela ..... 1768/74

[51] Int. Cl.[2] ..... F41B 15/00

[52] U.S. Cl. ..... 124/1; 124/41 R; 124/32

[58] Field of Search ..... 124/1, 9, 8, 16, 32, 124/34, 41, 43, 42; 46/82, 84, 85; 273/105.4

[56] References Cited

U.S. PATENT DOCUMENTS

| | | | |
|---|---|---|---|
| 2,189,763 | 2/1940 | Schimpfle | 46/84 |
| 2,603,203 | 7/1952 | Herold | 124/32 X |
| 2,781,753 | 2/1957 | Formis | 124/16 |
| 3,130,717 | 4/1964 | De Lossy et al. | 124/1 |
| 3,421,491 | 1/1969 | Brown | 124/9 |
| 3,572,712 | 3/1971 | Lau | 273/105.4 |

*Primary Examiner*—Harland S. Skogquist
*Assistant Examiner*—William R. Browne
*Attorney, Agent, or Firm*—Michael J. Striker

[57] ABSTRACT

A target pigeon has a hub centered on a pigeon axis and formed at this axis with a bore. A plurality of wings extend radially from the hub and each wing is tilted relative to the axis propeller-fashion so that when spun about the axis the pigeon will displace itself axially through the air. A launching apparatus has a base on which a support is pivotal about an upright axis. A launch head on the support is rotatable about an axis inclined upwardly to the horizontal and is formed with a tip receivable in the bore of the pigeon hub. A drive continuously rotates the head and the pigeon about the inclined axis and oscillates the entire support back and forth about the upright axis. A remotely controlled catch normally holds the pigeon on the launch head, but operation of this catch can release the pigeon which will fly off for shooting practice.

13 Claims, 23 Drawing Figures

FIG. 3
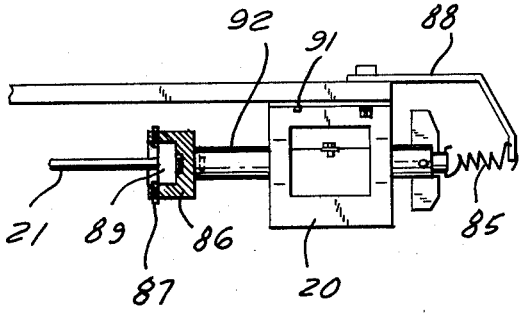
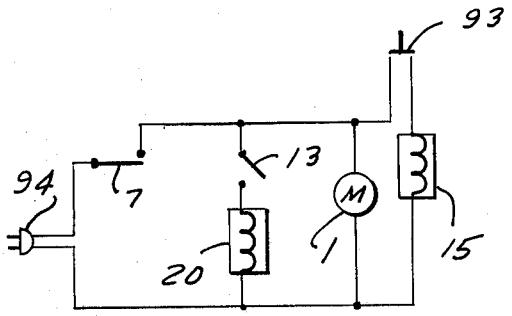
FIG. 4
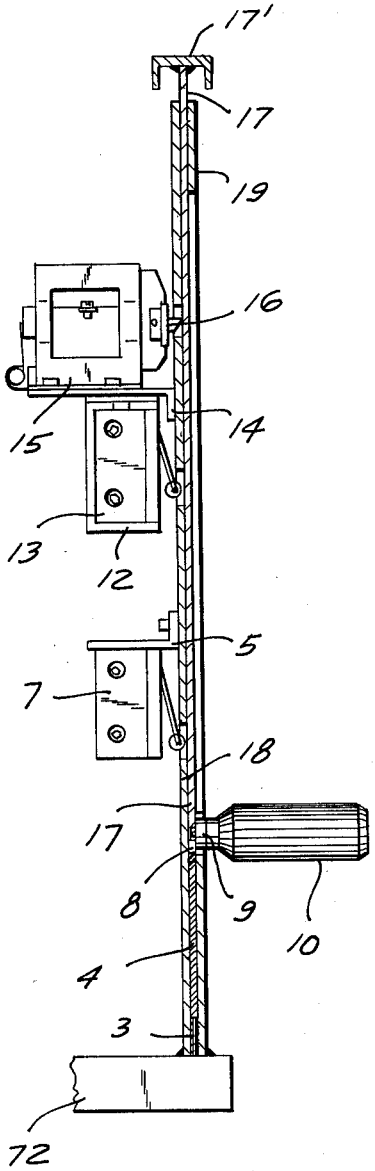
FIG. 5

FIG. 8
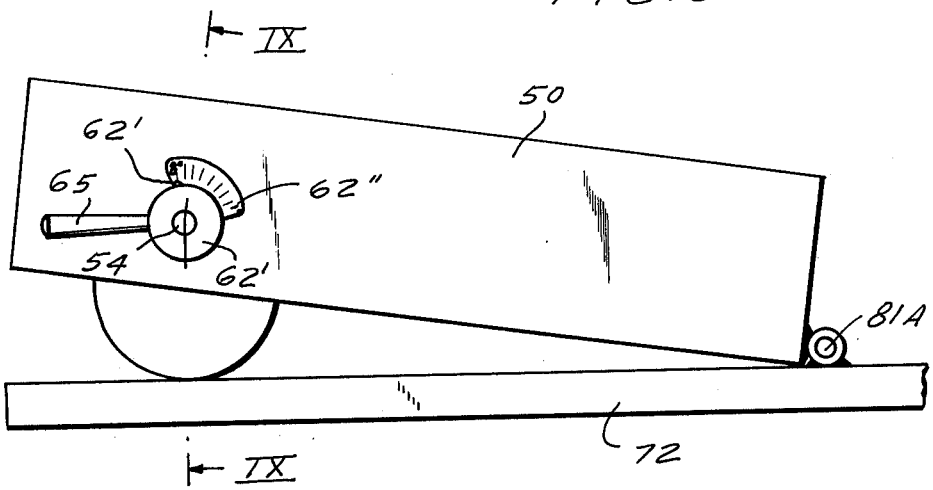
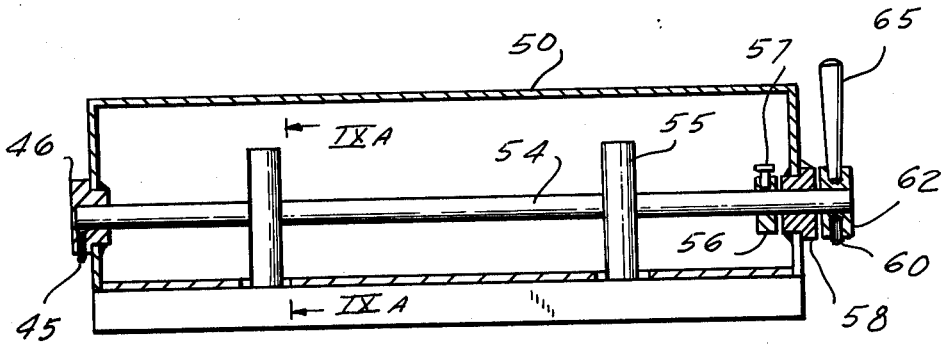
FIG. 9
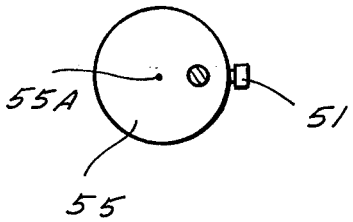
FIG. 9A

FIG. 12
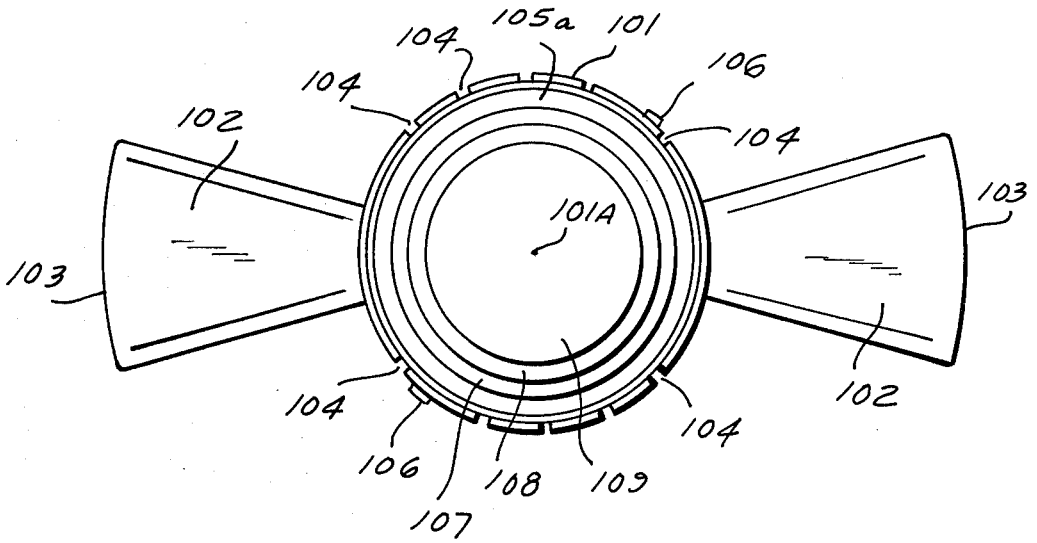
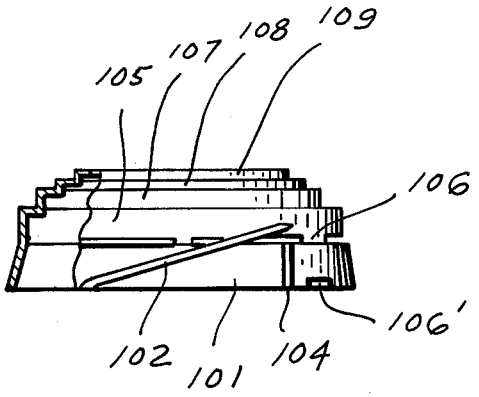
FIG. 13

TARGET PIGEON AND LAUNCHING APPARATUS THEREFOR

CROSS REFERENCE TO RELATED APPLICATION

This is a continuation-in-part of my copending patent application Ser. No. 604,069 filed 12 August 1975 and now abandoned.

BACKGROUND OF THE INVENTION

The present invention relates to a trap shooting system, More particularly, this invention concerns a target pigeon and apparatus for throwing such a target pigeon for shooting practices.

In trap or target-pigeon shooting a target pigeon is thrown up in the air to simulate a bird being driven out of the brush and the shooter, usually armed with a shotgun, fires at this target to sharpen his abilities for actual wing shooting. In order to maximize the effectiveness of such a practice, it is necessary that the trap or target pigeon be launched into the air in a manner closely resembling a bird in flight. Since, however, there are many different behavior patterns in game birds, it is necessary that some of the traps be shot straight up at a high speed, some fired out low and almost parallel to the ground, others be given a spin so as to change course, and various other random patterns must be duplicated.

The most widely used trap launcher simply has a spring-loaded arm on whose end the frangible target pigeon is secured. The arm is displaced back against the force of a spring and locked in place by a pawl which, when released, allows the arm to snap up and launch the pigeon into the air. Such a device is normally operated by a person other than the shooter from a pit at the end of the shooting range, or can be operated by the shooter himself through a trip cable. In order to vary the path or trajectory of the target it is necessary to reset the spring and physically turn the entire device around. Thus the possibility of reproducing random flight patterns is relatively difficult.

It has also been suggested to provide a pigeon which functions aerodynamically so that it can be launched and caused to follow its own trajectory. Nevertheless, the provision of the necessary launch arrangement has proven extremely complex and troubleprone. The use of an electric motor to launch the pigeon has been recommended, but the only way varying speeds and trajectories have been obtainable has been to use a direct-current motor in conjunction with complicated control circuitry. Such an arrangement is very troublesome and misfunctions often. Furthermore, the provision of a random firing angle, or range angle to be distinguished from the elevation angle which is the angle relative to the horizontal with which the pigeon is fired, has not been satisfactorily resolved.

SUMMARY OF THE INVENTION

It is therefore an object of the present invention to provide an improved system for target-pigeon or trap shooting.

Another object is the provision of an improved pigeon for such a system.

Yet another object is to provide an improved apparatus for throwing a target pigeon into the air.

Yet another object is to provision of an improved system wherein the target pigeon automatically will be thrown at a different range and elevation angles so as to duplicate different types of bird flight behaviors.

These objects are attained according to the present invention in a practice shooting system using a pigeon having a hub centered on a pigeon axis and formed at this axis with a bore and a plurality of radially extending flat wings on the hub each lying generally in a respective plane lying an at acute angle to the pigeon axis and inclined propeller-fashion oppositely to the plane of the other wing. The launching device comprises a base, a support pivotal on the base about an upright axis, a launch head on the support rotatable thereon about an axis inclined upwardly to the horizontal and formed with a tip centered on the inclined axis and engageable in the bore of the pigeon, drive means including motor connected to the support and to the launch head for oscillating the support about the upright axis for rotating the head simultaneously about the inclined axis to spin a pigeon on the head about the inclined axis. Means is provided on the launch head for securing the target pigeon on the head with the tip in the bore and for pushing the pigeon off the head along the inclined axis to launch it into the air.

According to further features of this invention the motor is a single speed alternating-current electric motor and is carried in the support pivotal on the base. This support is itself carried on a housing which is tippable about a generally horizontal axis relative to the base so as to control launch elevation angle. The rotation axis for the launch head extends at an angle of between 20° and 40°, and preferably 30° to the upright oscillating axis for the support. According to this invention the motor has a shaft extending parallel to the head rotation axis and at right angles to a swivel axis intersecting the upright pivot axis for the support.

In accordance with another feature of this invention a vertically displaceable slide is provided on the front of the apparatus which is displaceable into an up position by means of a manually operable handle, and which can be held in this up position by remotely actuatable solenoid. As this slide drops, after energization of this solenoid, it closes a first microswitch which operates a launch solenoid that pushes the target pigeon off the spinning head, and thereafter operates another normally closed microswitch which shuts down the entire device so that the support stops oscillating and the head stops spinning in order that the user may mount another pigeon on the now stationary head.

According to this invention, the tip of the launch head that fits into the hole in the target pigeon has an oblique head and is formed at one side with a hook so that as the pigeon is pushed off it is deflected laterally. Since the entire support for the launch head is oscillating back and forth about the above-mentioned upright axis and since the pigeon is pushed off over this hook the line of flight will be almost completely random. Thus the conditions of wing shooting are closely approximated without the necessity of the target shooter having to reset the apparatus for varying types of shots.

In accordance with further features of this invention the target pigeon is made at least in part of frangible material. This pigeon may be formed as a hub ring formed integrally with the above-mentioned wings, both the ring and the wings being of relatively flexible and durable material such as polyethylene. Provided on this hub is a cap formed generally as a flat or stepped cylindrical disc and made of highly frangible material such as baked clay. The hub is formed offset from the central axial bore with another bore extending parallel to the axis and adapted to receive an off-centered pin carried on the launch head. This pin on the launch head therefore transmits torque to the pigeon to spin the same. A pair of such pins diametrically may flank the central launch tip.

It is also possible in accordance with this invention to provide a separate drive board which by remote control permits automatic operation of various modes by means of an electro-pneumatic computing system in conjunction with manually settable program means for the whole system.

With the system according to the present invention the target, once spun at high speed, takes off virtually by itself so that it can be given a very long flight path, closely resembling that of a flushed game bird. Furthermore, the target shooter is not able to know in advance the particular course to be followed by the next target pigeon, as the range and elevation, as well as the shape of the trajectory will change from shot to shot at random. In this manner the conditions of wing shooting are closely emulated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a side view partly in section of the launch solenoid assembly;

FIG. 4 is a schematic view illustrating the electrical connections for the apparatus;

FIG. 5 is a vertical section through the front part of the apparatus;

FIG. 8 is a side view of the lower part of the apparatus showing the elevation control;

FIGS. 9 and 9A are sectional views taken along lines IX—IX and IXA—IXA of FIGS. 8 and 9, respectively;

FIGS. 12 and 13 are top and side views of another target pigeon according to the present invention.

DESCRIPTION OF THE PREFERRED EMBODIMENTS

Figure 1:
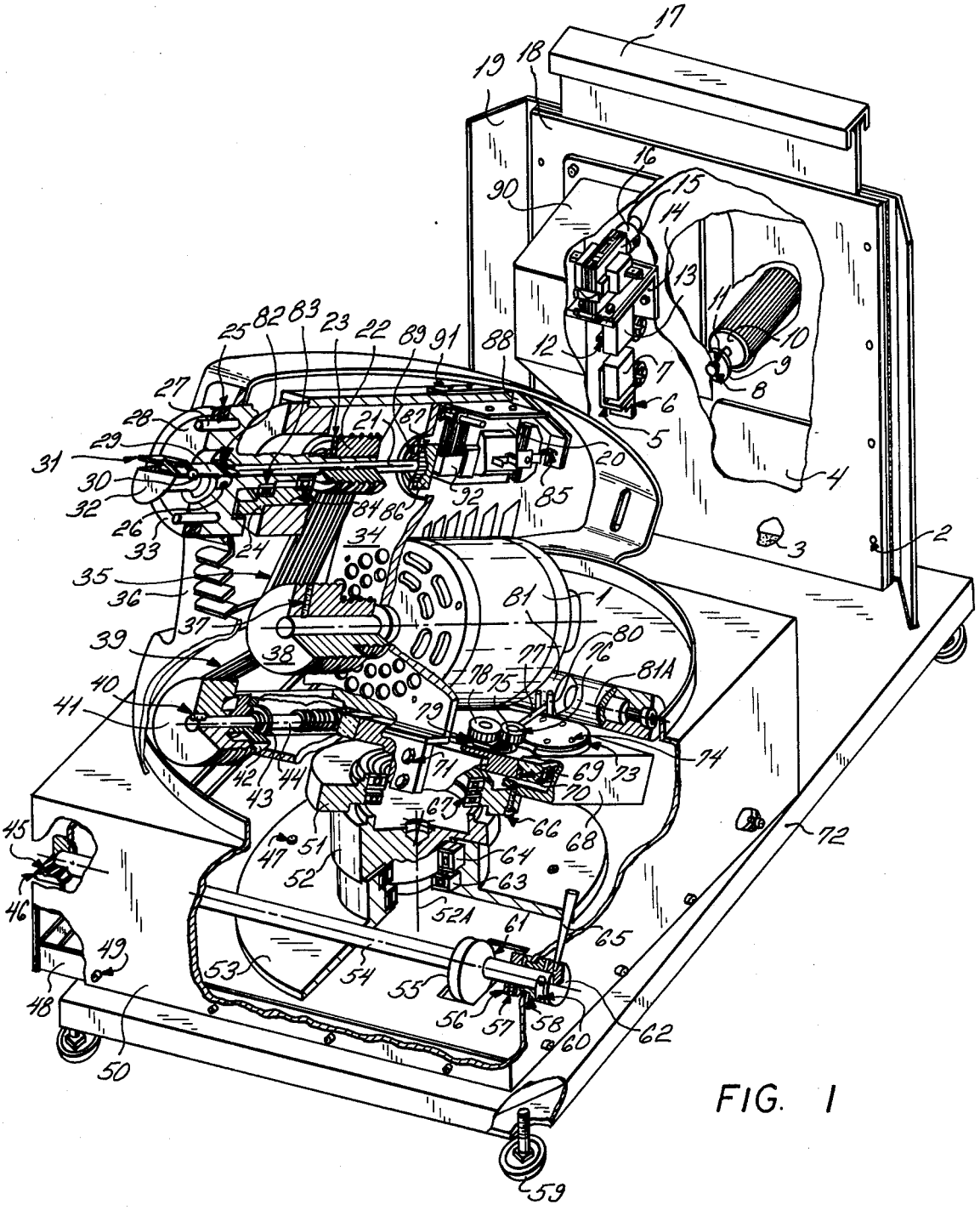
FIG. 1 is a perspective view partly broken away of the apparatus according to the present invention.

With reference only to FIG. 1 the apparatus according to the present invention has a base 72 adapted to stand on the ground or a floor via adjustable feet 59 and formed as a rigid hollow metal body. At the front end of this base 72 there is an upright plate 19 carrying the operating slide and other equipment described hereinbelow. Pivotal about an axis 81A defined by a hinge 81 is a lower housing 50 of box-like shape and provided with a rigidifying frame 48 held in place by screws 49. Pivotal about a vertical axis 52A on this lower housing 50 is an upper housing 36 having a base plate 68 to which is secured via screws 71 and upright bracket plate 34 carrying a drive motor 1 for the apparatus. The oscillating mechanism described below as well as the launch mechanism are carried on this upper housing 36.

Figure 2A:
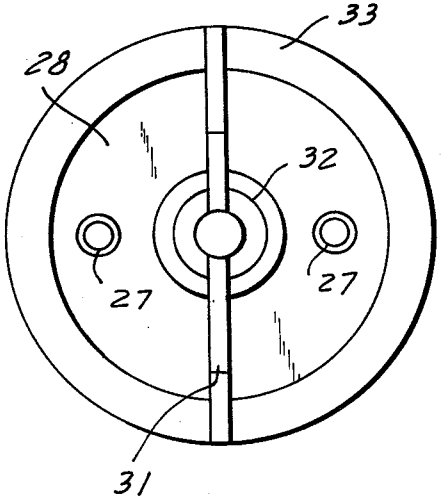
FIG. 2A is a front view of the assembly of FIG. 2.
Figure 2:
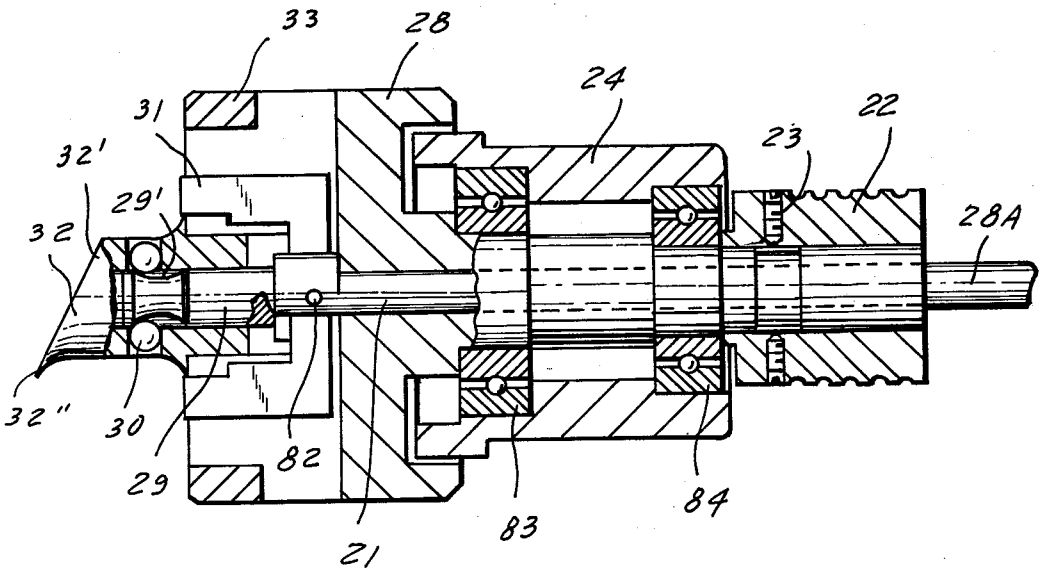
FIG. 2 is an axial section through the launching-head assembly.
Figure 2E:
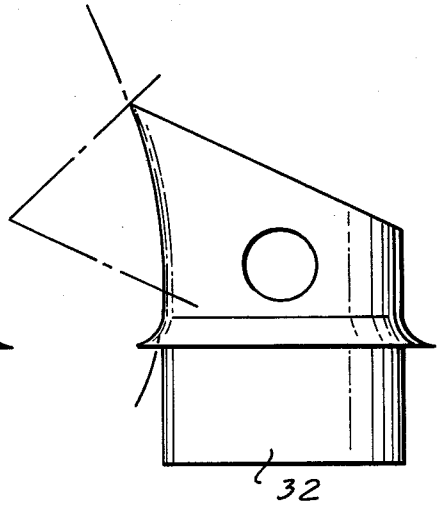
FIGS. 2B–2E are side large-scale views illustrating functioning of the launching trip.
Figure 2D:
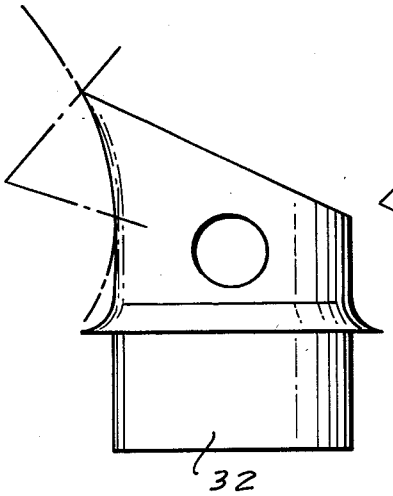
Figure 2C:
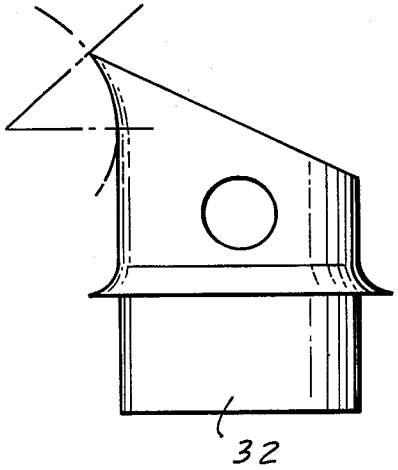
Figure 2B:
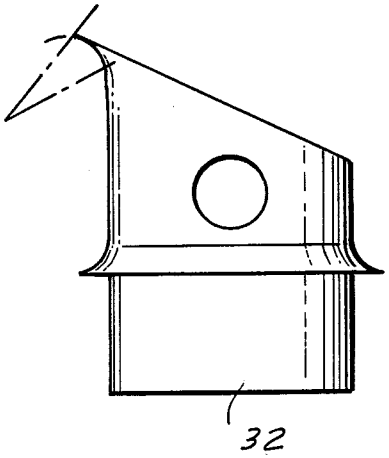

Launch head assembly shown in FIGS. 2 and 2A has a head or arbor 28 rotatable about an axis 28A in bearings 83 and 84 carried in a sleeve 24 fixed to the bracket plate 34. This arbor 28 has a shank carrying a multiple-belt pulley 22 rotationally secured to the shank by screws 23. Belts 35 spanned over a pulley 38 secured by a set screw 37 to the shaft of the motor 1 serve to rotate this head about the axis 28A.

The front face of the head 28 is provided with a circumferential ring 33 secured in place by screws 25 (FIG. 1). Passing axially through the head 28 is a rod 21 secured at its front end via a screw 82 to a push-off fork or bracket 31 axially slidable within a diametrical slot cut in the head 28.

Front face of the head 28 is formed with a launching tip 32 having an oblique surface 32' and a hooked over tip or point 32''. Slidable within this tip 32 is a short rod 29 connected via screws 26 (FIG. 1) to the rod 21 for joint axial movement therewith. This short rod 29 is formed with a circumferential groove 29' in which are engageable balls 30 radially displaceable in the tip 32. Projecting axially from the front of the head 28 to either side of the bracket 31 and tip 32 is a pair of pins 27 that insure proper rotational entrainment of a target pigeon described below.

The rear end of the rod 21 shown in FIG. 3 is secured in an axial-thrust bearing 89 held in a socket 86 by screws 87. A solenoid 20 mounted by screws 91 has a core 92 reciprocal along the axis A and carrying the socket 86. A spring 85 between the end of the core 92 and a bracket 88 holds the elements in the illustrated position. Thus electrical energization of the solenoid 20 will pull the core 92 to the left as shown in FIG. 3 and will push the ejector fork 31 shown in FIG. 2 similarly to the left, simultaneously allowing the balls 30 to fall into the groove 29'.

A target pigeon as described with reference to FIGS. 10 and 11 below will when thus pushed off the end of the tip 32, fly off at any of a variety of different angles as indicated in FIGS. 2B–2E. Thus the direction of flight will be largely random so as to closely simulate the conditions of wing shooting.

FIG. 5 shows a plate 18 secured to the back of plate 19 by screws 2 but spaced therefrom. A plate 17 is vertically displaceable between these plates 18 and 19 and carries at its upper end a downwardly U-shaped rail 17' that reaches over the top of these plates 18 and 19 when the plate 17 is dropped as shown in FIG. 5 to prevent rain or the like from entering. Plate 17, when dropped as shown in FIG. 5, rests on a plate 4 itself standing on a rubber neonprene bumper 3 between the plates 18 and 19. The plate 19 is slotted and the plate 17 is formed behind this slot with a hole 11 over top of which is welded a nut 9 so that a shank 8 on a handle 10 can be screwed to this plate 17 and allow it to be raised. This gate or plate 17 can be held up by a solenoid 15 carried on a mounting bracket 14 on the plate 18 and having a nose or hook 16 engageable through a hole in the plate 18 with the plate 17. A normally open microswitch 13 is mounted via a bracket 12 on the plate 18 and is engageable through this plate 18 with the lower edge of the gate 17. Below this switch 13 and secured via screws 6 to a bracket 5 is a normally open microswitch 7 similarly engageable through the plate 18 with the lower edge of the plate 17. A box-like cover 90 protects these circuit elements 7, 13 and 15 from the elements.

As shown in FIG. 4 once the gate 17 is lifted up by means of the handle 10, which action is only done after a pigeon has been mounted on the head 28, the switch 7 closes so as to energize the motor 1 and start the head 28 spinning at high speed, here 6500 RPM. The shooter, at a remote location if desired, then actuates a switch 23 which energizes the solenoid 15 and allows the gate 17 to drop. As this gate drops it first closes the switch 13, thereby energizing the relay 20 and pushing the pigeon off the head 28, and then opens the switch 7 so as to disconnect the motor 1 and the entire circuit. As the gate 17 comes to rest on the plate 8 it makes the same type of sound as is made by a conventional trap arrangement so that a trap shooter habituated to a mechanical spring-loaded trap shooting device will hear the noise he is accustomed to hearing as the pigeon is launched. Thereafter another pigeon may be fitted over the head 28 and the gate 17 lifted to recycle the device.

Figure 6:
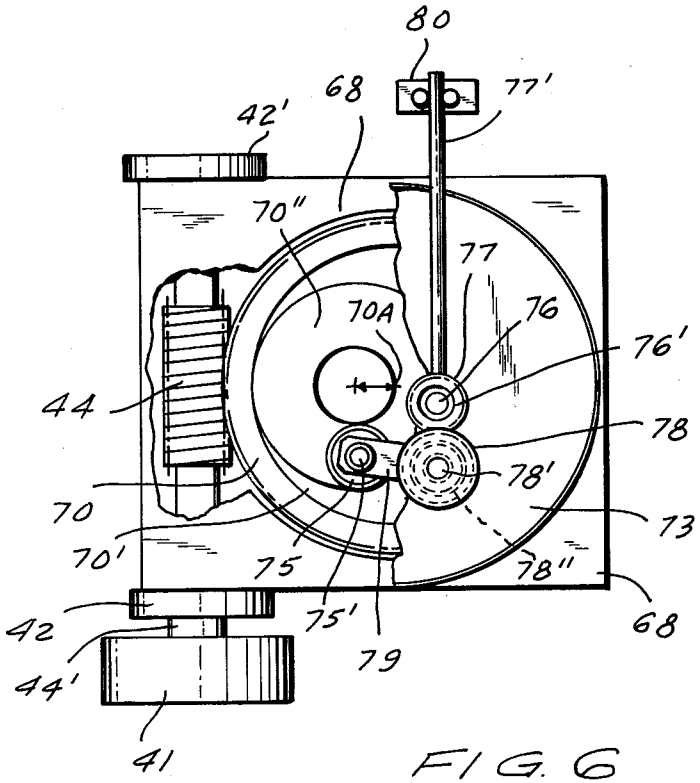
FIG. 6 is a top view partly broken away of the oscillating drive.
Figure 7:
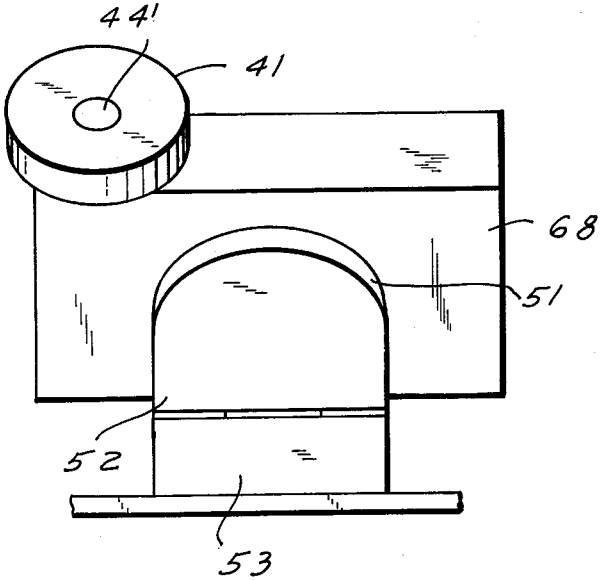
FIG. 7 is a front view of the drive of FIG. 6.

The upper housing 36 is oscillated back and forth about the axis 52A by the mechanism shown in FIGS. 6 and 7. The multiple-belt pulley 38 on the shaft of the motor 1 is also connected via drive belts 39 to a drive pulley 41 connected via a key 40 to a shaft 44' carrying an oscillation worm 44 and rotatable in a bearing 43 held in place by holding ring 42. Another holding ring 42' is provided with another bearing at the opposite end of the shaft 44' (see FIG. 1 also). The worm 44 meshes with a toothed brass crown 70 carried on a steel disc 70' rotatable about an axis 70A that intersects the axis 52A at an angle of 30°.

This disc 70 is formed with a circularly annular cam groove 70' having an internal radius of curvature *r* and positioned such that the internal periphery of the groove 70'' is always on the axis 70A. A cam-follower roller 75 rotatable about a pin 75' of a link or crank arm 79 rides in the groove 70''. The other end of this crank arm 79 is press-fitted to a pin 78' passing through a bearing 78'' carried in a cover 73 and carrying on its upper end a gear 78. Another gear 77 smaller than the gear 78 meshes with this gear 78 and rotates via a bearing 76' on a pin 76 fixed to the cover 73. A radially extending arm 77' extends beyond the base 68 and projects between two parallel generally vertical pins 80 acting as a fulcrum.

The disc 73 is secured view screws 74 to the base 68 which in turn is secured via screws 66 to a disc 51 itself carried on a support hub 52 rotatable about the axis 52A on a plate 53 via bearings 63 and 64. Bearings 67 are provided to allow the discs 70 and 70' secured together by keys 69 to turn relative to the plate 51 about the axis 70A. The plate 53 is held by screws 47 inside the lower housing 50.

This oscillation mechanism functions as illustrated in FIG. 14A–14D to oscillate the gear 78 by the crank arm 79 about its axis 78A. The roller 75, rotates about its own axis 75A as the disc 70' rotates and the groove 70'' orbits about the axis 70A. The distance between the axis 75A and 78A is equal to $2r$ so that as the disc rotates in the direction indicated by the arrows in FIGS. 14A–14D the arm 79 will oscillate back and forth about the axis 78A through an angle of approximately 90°. Since the gear 77, not shown in FIGS. 14A–14D is smaller than the gear 78, this gear will oscillate through a slightly larger angle to swing the entire base 68 back and forth through an angle of 120° by levering against the pins 80 with the rod 77'.

Thus the one motor 1 serves both to rotate the head 28 and to oscillate the entire housing 36 back and forth about the axis 52A. The axis 70A lies at an angle of 30° to the axis 52A to enable the single motor to drive both of the pulleys 22 and 41 and to aim the head 28 at an angle of approximately 30° to the horizontal.

In order to change the elevation angle of launch the mechanism provided in FIG. 8 is employed.

The lower housing 50 is connected via a hinge 81 to the base 72 so as to be pivotal about the horizontal axis 81A described above. This housing 50 is provided on opposite sides with journals 46 and 58 through which passes a rod 54 parallel to the axis 81A and carrying a pair of eccentric discs 55 as shown in FIG. 9A. Lock screws 61 are provided to hold these discs 55 in place on the shaft 54 and a ring 56 is held via a screw 57 on the shaft 54 in order to prevent it from sliding out of the housing 50.

The outside end of the shaft 54 is provided with a hub 62 locked rotationally in place by a lock screw 60 and carrying a level or elevation-adjust handle 65. A pointer 62' on the hub 62 cooperates with a degree scale 62'' on the side of the housing 50.

In order to adjust the elevation the handle 65 is pivoted until the pointer 62' points to the desired elevational angle and then a lock screw 45 in the journal 46 is tightened to secure the shaft 54 in place. At the 0° setting the discs 55 are completely retracted within the housing 50 as illustrated in FIG. 9 whereas at the 8° setting the central axes 55A of these discs lie directly below the rod 54. Thus the user can adjust the device to get up to 8° more loft than normal.

Figure 11:
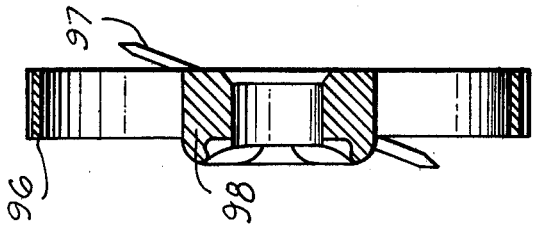
FIGS. 10 and 11 are top and side-sectional views, respectively, of a target pigeon usable with the apparatus according to this invention.
Figure 10:
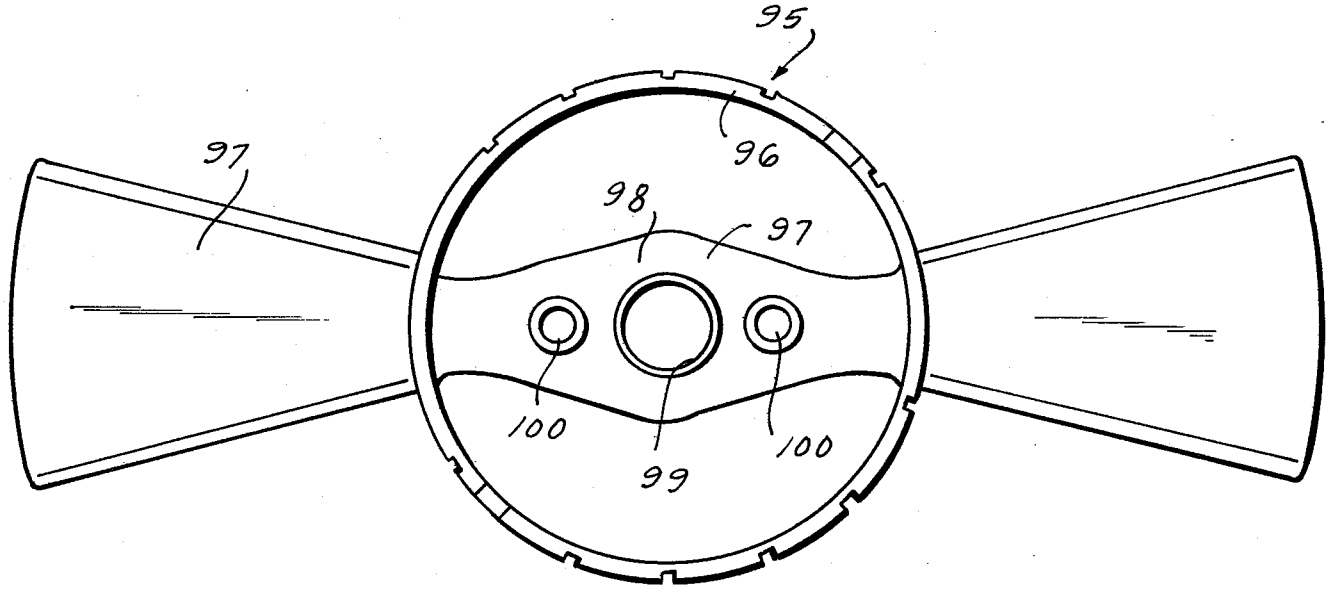
Figure 14A:
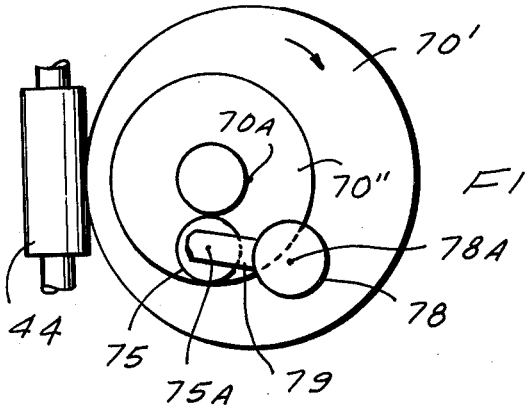
FIGS. 14A–14D are diagrammatic views illustrating operation of the oscillation drive shown in FIGS. 6 and 7.
Figure 14B:
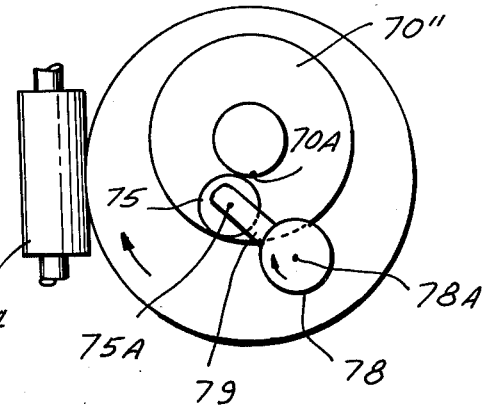
Figure 14C:
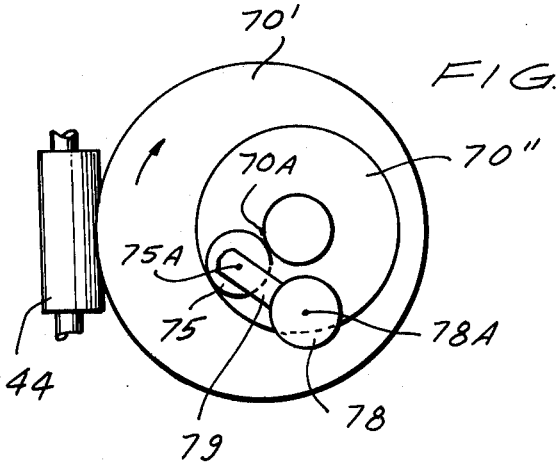
Figure 14D:
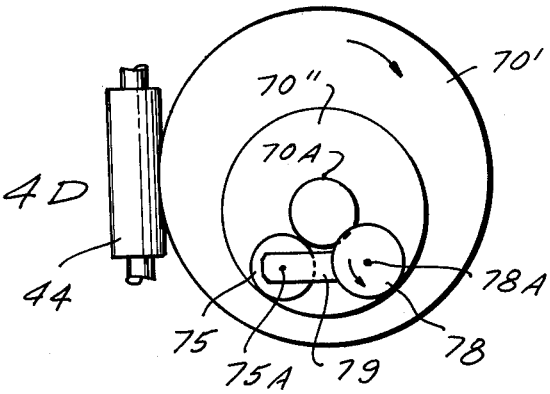

FIGS. 10 and 11 show a pigeon 95 having an annular hub 96 and a pair of wings 97 tipped oppositely propeller-fashion. The central part of this hub 96 has a cross member 98 formed with a central hole 99 adapted to fit over the launching tip 32 and a pair of spaced apart holes 100 each adapted to receive a respective rotation pin 27.

Such a launching pigeon 95 is fitted over the head 28 so that, when rotated at the high speed of 6500 RPM it will, when released by the balls 30 and pushed off by the ejector fork 31, fly away from the trap launcher at high speed. The range and elevation will be virtually random due to the shape of the head 32 and what position the assembly 36 is in when the switch 93 is closed to connect the solenoid 15 to the power supply 94.

FIGS. 12 and 13 show another type of pigeon having a central cylindrically tubular hub 101 centered on an axis 101A and having a diameter of 110 mm and an axial length of 15 mm. Two blades 102 each 85 mm long and 2.5 mm thick extend from the hub 101 and are 30 mm wide at their base and 70 mm wide at their curved outer ends 103. The blades 103 are inclined at 15° oppositely to one another propeller-fashion. The hub 101 is formed on each side between the blades 103 with five square-section grooves 104 extending parallel to the axis 101A and measuring 1.0 mm wide and 1.0 mm deep.

Over top of the hub 101 there is formed a cap 105 having a diameter of 105 mm and a height of 9.5 mm and connected via small feet 106 to the hub 101. This cap has a closed base 105A formed with three steps, a first step 107 of 90 mm in diameter and 7.2 mm in height, a second step 108 of 80 mm in diameter and 3 mm in height, and a third step 109 of 70 mm in diameter and 3 mm in height.

It is noted that the hub 101 and wings 102 can be formed identically to the arrangement shown in FIGS. 10 and 11 whereas the assembly secured via the feet 106 having outwardly projecting tabs 106' is fitted over this winged element and constitutes a separate unit. Such a structure makes it possible to form the wings 102 of relatively flexible material, but the center part of extremely frangible material so that the wings will not fly off when the device is spun at high speed but the center will shatter relatively easily to register a hit.

The apparatus according to the present invention facilitates trap shooting with conditions extremely similar to those of wing shooting. The device tosses the pigeons at extremely high speed into the air in directions that are virtually random so that the shooting closely simulates real wing shooting. Some of the traps will be shot off in a low flat trajectory relatively close to the ground and others will be lofted high, at the same time the housing, pivoting back and forth through 120° can launch the pigeons in any range direction too.

It will be understood that each of the elements described above, or two or more together, may also find a useful application in other types of constructions differing from the types described above.

While the invention has been illustrated and described as embodied in a target pigeon and launching apparatus therefor, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for throwing a target pigeon, said apparatus comprising:

a base;

a support pivotal on said base about an upright axis;

a launch head on said support rotatable about a launch axis inclined upwardly to the horizontal and having at said launch axis a tip engageable through a target pigeon;

drive means including a motor connected to said support and to said launch head for oscillating said support about said upright axis and for rotating said head simultaneously about said launch axis, whereby a target pigeon fitted to said tip can be spun at high speed about said launch axis;

means responsive to longitudinal movement of a shaft and including a radially displaceable holding element at said tip lockingly engageable with a target pigeon fitted thereto for positively securing a target pigeon on said tip; and means connected to said holding element and having a pushing element for releasing said holding element from a target pigeon engaged thereby and for pushing same off said head with said pushing element when said head is spinning to launch said pigeon into the air.

2. The apparatus defined in claim 1 wherein said means for positively holding includes a remotely operable solenoid connected to said elements.

3. The apparatus defined in claim 1 wherein said motor is a single-speed alternating-current electric motor.

4. The apparatus defined in claim 1 wherein said tip is generally cylindrical and is formed with an oblique end surface and a laterally extending hook.

5. The apparatus defined in claim 4 wherein said element is pushing includes an ejector fork at said tip displaceable along said launch axis.

6. The apparatus defined in claim 1 wherein said inclined axis extends at an angle of between 20° and 40° to the horizontal.

7. An apparatus for throwing a target pigeon, said apparatus comprising:

a base, a support pivotal on said base about an upright axis, a launch axis inclined upwardly to the horizontal, drive means including a motor connected to said support and to said launch head for oscillating said support about said upright axis and for spinning said head simultaneously about said launch axis, means responsive to solenoid operation for securing a target pigeon on said head and for pushing same off said head when said head is spinning to launch said pigeon into the air, a slide vertically displaceable on said base between an up position and a down position, a handle on said slide permitting manual vertical displacement thereof from said down position to said up position, a retaining hook engageable with said slide to maintain same in said up position, a drop solenoid connected to said hook to pull same out of the path of said slide and allow same to drop from said up position into said down position, a launch solenoid connected to said head for releasing said pigeon thereon, a switch engageable by said slide on displacement thereof from said up position to said down position, and circuit means interconnecting said switch, said motor, and said solenoids for releasing said slide with said drop solenoid and thereafter actuating said launch solenoid to release said pigeon.

8. A practice shooting system comprising:

a target pigeon having a hub centered on a pigeon axis and formed at said axis with a bore, and a plurality of radially extending flat wings on said hub each lying generally in a respective plane lying at an acute angle to said pigeon axis and inclined propeller-fashion oppositely to the plane of the other wing;

a base;

a support pivotal on said base about an upright axis;

a launch head on said support rotatable thereon about a launch axis inclined upwardly to the horizontal and formed with a generally cylindrical tip centered on said launch axis and engageable in said bore, said tip being formed with an oblique end surface and a laterally extending hook;

drive means including a motor connected to said support and to said launch head for oscillating said support about said upright axis and for spinning said head simultaneously about said launch axis to spin a pigeon on said head about said launch axis; and means responsive to solenoid operation for securing said target pigeon on said head with said tip in said bore and for pushing said pigeon off said head along said launch axis and over said hook to launch said pigeon into the air, whereby the spinning pigeon is deflected laterally by said hook and follows a trajectory skew to said launch axis as a result of this deflection.

9. The system defined in claim 8 wherein said motor is in said support.

10. The system defined in claim 8 wherein said head is provided adjacent said tip with a pin projecting from said head parallel to said inclined axis, and said target pigeon is formed with an eccentric hole engageable over said pin on fitting of said tip into said bore, whereby said pin transmits torque from said head to said pigeon.

11. The system defined in claim 8, further comprising means for tipping said support relative to said base about a generally horizontal axis.

12. An apparatus for throwing a target pigeon, said apparatus comprising:

a base;

a housing on said base;

a support pivotal on said housing about an upright axis;

means for tipping said housing and said support relative to said base about a substantially horizontal axis;

a launch head on said support rotatable thereon about a launch is inclined upwardly to the horizontal;

drive means including a motor connected to said support and to said launch head for oscillating said support about said upright axis and for spinning said head simultaneously about said launch axis; and means responsive to solenoid operation for securing a target pigeon on said head and for pushing same off said head when same is spinning to launch said pigeon into the air.

13. A practice shooting system comprising:

a target pigeon having a hub centered on a pigeon axis and formed at said pigeon axis with a bore, and a plurality of radially extending flat wings on said hub each lying generally in a respective plane lying at an acute angle to said pigeon axis and inclined propeller-fashion oppositely to the plane of the other wing;

a base;

a support pivotal on said base about an upright axis;

a launch head on said support rotatable thereon about a launch axis inclined upwardly to the horizontal and formed with a tip centered on said launch axis and engageable in said bore;

drive means including a motor in said support and connected to said support and to said launch head for oscillating said support about said upright axis and for rotating said head simultaneously about said launch axis to spin a pigeon on said head about said launch axis;

means responsive to solenoid operation for securing target pigeon on said head with said tip in said bore and including a ball in said tip radially displaceable of said inclined axis, a link, and a remotely operable solenoid connected via said link to said ball; and means for pushing said pigeon off said head along said launch axis to launch said pigeon into the air.

* * * * *